United States Patent [19]

Pfarrwaller

[11] Patent Number: 4,593,724

[45] Date of Patent: Jun. 10, 1986

[54] GUIDE FOR A WEFT-PICKING PROJECTILE IN A WEAVING MACHINE

[75] Inventor: Erwin Pfarrwaller, Winterthur, Switzerland

[73] Assignee: Sulzer Brothers Limited, Winterthur, Switzerland

[21] Appl. No.: 740,989

[22] Filed: Jun. 4, 1985

[51] Int. Cl.[4] ..... D03D 49/60

[52] U.S. Cl. ..... 139/188 R; 139/439

[58] Field of Search ..... 139/435, 439, 188 R, 139/192

[56] References Cited

U.S. PATENT DOCUMENTS

| | | | |
|---|---|---|---|
| 2,538,630 | 1/1951 | Rusnou | 139/188 R |
| 3,556,163 | 1/1971 | Pfarrwaller | 139/188 R |
| 3,667,508 | 6/1972 | Inglin | 139/188 R |

FOREIGN PATENT DOCUMENTS

| | | | |
|---|---|---|---|
| 53217 | 6/1982 | European Pat. Off. | 139/439 |
| 2628625 | 6/1976 | Fed. Rep. of Germany | 139/188 R |

*Primary Examiner*—Henry S. Jaudon
*Attorney, Agent, or Firm*—Kenyon & Kenyon

[57] ABSTRACT

The projectile guide comprises guide teeth whose exit aperture for the weft yarn is subject to the following conditions in relation to the projectile:

$$x=b;\ x=l;\ y=d;$$

where x denotes the horizontal distance between the vertical centerline of the projectile and the end of the guide hook of a guide tooth; b denotes half the width of the projectile; l denotes the horizontal distance between the center M of the projectile and the free end of the support; y denotes the vertical distance between the free end of the support and the horizontal inside edge of the hook; and d denotes the vertical distance between the horizontal inside edge of the hook and the horizontal centerline of the projectile.

2 Claims, 2 Drawing Figures

GUIDE FOR A WEFT-PICKING PROJECTILE IN A WEAVING MACHINE

This invention relates to a guide for a weft-picking element in a weaving machine and, particularly, a gripper projectile weaving machine.

As is known, the guides for a weft-picking element, such as a gripper projectile, have frequently been formed of a plurality of sequentially disposed guide teeth, for example as described in Swiss Pat. Nos. 465,521 and 315,854. Generally, these guide teeth have provided sufficient support surfaces for guiding a picking element but have had a relatively small exit aperture for a weft yarn. As a result, so far as shedding geometry for producing fabric patterning is concerned, when the guide moves downwardly out of the shed with a simultaneous closure of the shed, the weft yarn is impeded when leaving the guide. This disadvantage is particularly manifest in the so-called "in-the-bag weaving". In this case, the top and bottom warp yarns cross at a relatively low level, that is, below the normal weaving plane. The weft yarn thus grazes hard on the top inside edges of the guide teeth causing an unwanted streakiness in the appearance of the woven fabric.

Accordingly, it is an object of the invention to obviate streakiness in the woven fabric due to a grazing of a weft yarn in a weft picking element guide.

It is another object of the invention to provide a guide for a weft-picking element which is constructed to avoid streakiness in a woven fabric.

Briefly, the invention provides a guide for a weft-picking element in a weaving machine which is comprised of a plurality of sequentially disposed guide teeth each of which has a guide hook and a support defining a picking element receiving passage with a transverse exit aperture for a weft yarn. In accordance with the invention, the guide hook and the support are dimensioned relative to each other to provide an enlarged aperture through which a weft yarn may exit during the close of a shed and a withdrawal movement of the guide from the shed.

By enlarging the exit aperture, the weft yarn can exit without hinderance from the shed when the guide moves out of the shed. Further, the enlargement of the exit aperture delays the time at which the fabric is contacted by the guide teeth when the guide first enters into the shed. Hence, a more regular fabric texture can be obtained.

Figure 1:
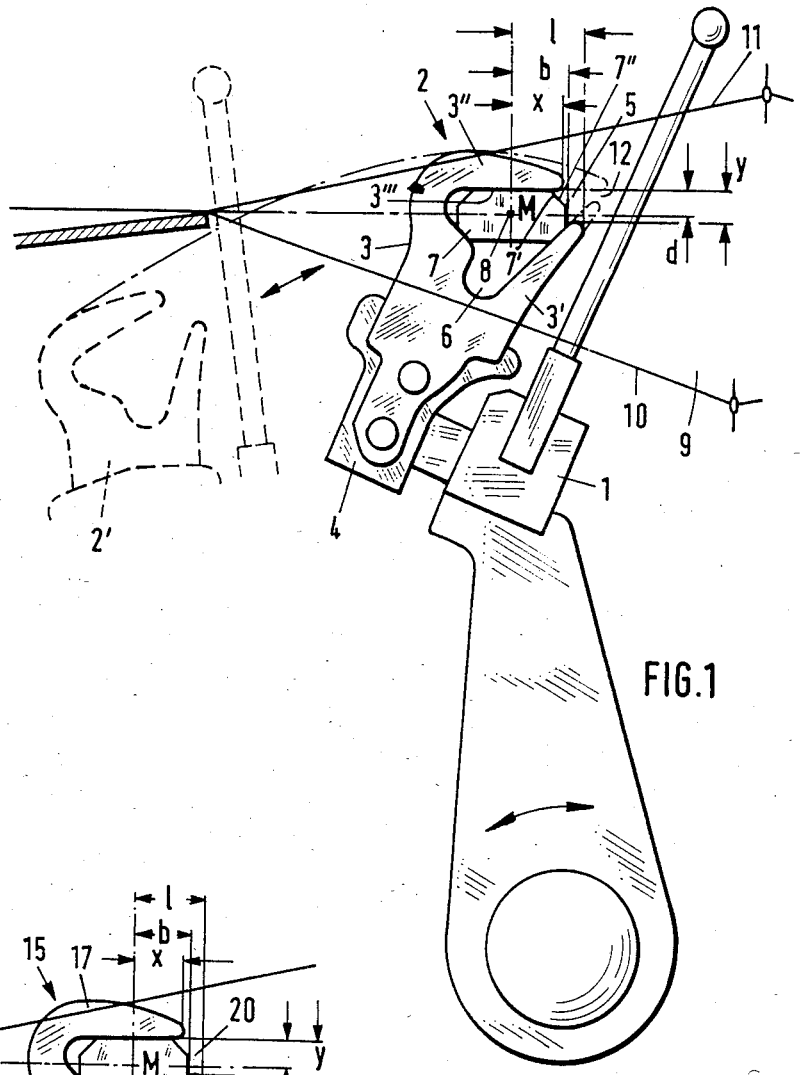
Figure 2:
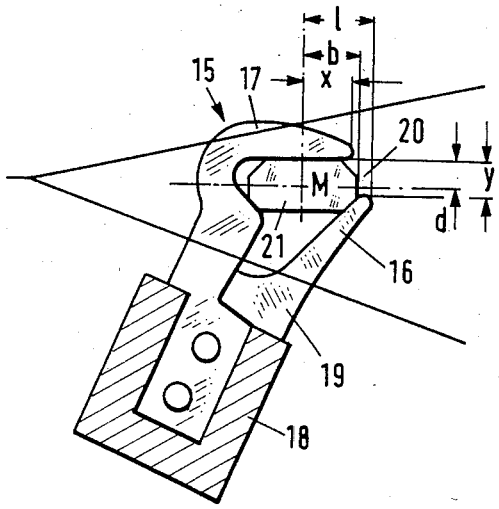

These and other objects and advantages of the invention will become more apparent from the following detailed description taken in conjunction with the accompanying drawings wherein:

FIG. 1 illustrates a side view of a guide for a weft-picking element constructed in accordance with the invention; and FIG. 2 illustrates a side view of a modified guide employing separated guide hooks and supports.

Referring to FIG. 1, the guide 2 for a weft-picking element, for example in the form of a projectile 7, is mounted on a sley 1 of a weaving machine such as a gripper projectile weaving machine. The guide 2 is formed of a plurality of sequentially disposed guide teeth 3 which are cast into a block 4.

Each guide tooth 3 is formed with a support 3′ and a hook 3″ which define a picking element receiving passage 6 with a transverse exit aperture 5 for a weft yarn 8. As indicated, the support 3′ and hook 3″ are of a length such that the weft yarn exit aperture 5 is only a short distance away from an adjacent side 7′ of the projectile 7 and extends substantially parallel to a bevelling 7″ of the projectile 7.

As indicated in FIG. 1, when the projectile 7 is passing through the guide passage 6, the projectile 7 is supported along three surfaces, one on the support 3′ and two on the guide hook 3″. When the projectile 7 passes through the guide passage 6, the sley 1 with the guide 2 is disposed in a shed 9 formed by warp yarns 10, 11. After the projectile 7 has passed through the passage 6 with the entrained weft yarn 8, the guide 2 is moved out of the shed 9 to take up the position indicated in dotted line 2′. At the same time, the weft yarn 8 is beat-up into the shed 9.

The exit aperture 5 is dimensioned relative to a projectile 7 in the passage 6 in accordance with the following conditions.

First, the horizontal distance x between a vertical centerline of the passage 6 (and of the projectile 7) and a free end of the hook 3″ is equal to or less than the half-width b of the projectile 7 in the passage 6. Second, the horizontal distance x is equal to or less than a horizontal distance 1 between a center M of the guide passage 6 (and of the projectile 7) and the free end of the support 3′. Third, the vertical distance y between the free end of the support 3′ and an inside horizontal edge 3‴ of the hook 3″ is equal to or greater than a vertical distance d between the inside horizontal edge 3‴ and a horizontal centerline of the passage 6 (and of the projectile 7).

In summary, the dimensions for the exit aperture 5 are as follows:

$$x \leqq b;\ x \leqq 1;\ y \geqq d;$$

Referring to FIG. 1, by way of comparison, a guide tooth of known construction is shown in chain lines with an exit aperture 12 of much smaller dimension than the exit aperture 5. As indicated by the chain lines, the support and hook of the known guide tooth are spaced so close to each other as to leave only a very small exit aperture.

Because of the relatively large exit aperture 5, the weft yarn 8 can exit without hinderance from the shed 9 when the guide 2 moves downwardly out of the shed 9 for beating-up of the weft yarn 8 with a simultaneous closure of the shed 9. The increased weft yarn exit aperture 5, that is, the shortening of the guide hook is particularly advantageous since the fabric is contacted by the guide teeth later than with the previously known guide teeth when the guide 2 enters the warp. Further, since the movement of the guide from the warp occurs earlier than in previous constructions, the warp yarns 10 have more time to return to their true pitch position after being displaced. Thus, a more regular fabric texture is provided. This latter feature is very advantageous when weaving with untwisted filament yarns since guide teeth often penetrate between the discrete fibrils of the filaments of such yarns, usually with unwanted disburances of the fabric texture.

Referring to FIG. 2, wherein like references characters indicate like aparts as above, instead of forming the guide of undivided teeth, the guide 15 includes a plurality of supports 16 and guide hooks 17 which are disposed in alternating sequentially disposed relation such that each guide hook 17 and support 16 defines a guide tooth 19, a picking element receiving passage and a transverse exit aperture 20 for the weft yarn. As indicated, the support 16 and hook 17 are cast in a block 18 and alternate with one another along the guide 16 to complement one another in pairs.

As indicated, a projectile 21 is guided between the support 16 and hooks 17 while the exit aperture 20 is dimensioned as described above with respect to the embodiment of FIG. 1.

Although the guide is described with reference to gripper projectile weaving machines, the guide may also be used on other kinds of weaving machines, for example on band gripper weaving machines.

The invention thus provides a guide through which a weft-picking element may be passed with an entrained weft yarn and subsequentially moved out of a shed without grazing the weft yarn to a degree sufficient to produce steakiness in the woven fabric.

What is claimed is:

1. A guide for a weft-picking element in a weaving machine, said guide including a plurality of sequentially disposed guide teeth, each said tooth having a guide hook and a support defining a weft picking element receiving passage with a transverse exit aperture for a weft yarn, wherein a horizontal distance x between a vertical centerline of said passage and a free end of said hook is equal to or less than a half-width b of said picking element in said passage and equal to or less than a horizontal distance l between a center of said passage and a free end of said support and wherein a vertical distance y between said free end of said support and an inside horizontal edge of said hook is equal to or greater than a vertical distance d between said inside horizontal edge of said hook and a horizontal centerline of said passage.

2. A guide for a weft-picking element in a weaving machine, said guide including a plurality of guide hooks and supports disposed in alternating sequentially disposed relation, each said guide hook and adjacent support defining a weft picking element receiving passage with a transverse exit aperture for a weft yarn wherein a horizontal distance x between a vertical centerline of said passage and a free end of said hook is equal to or less than a half-width b of said weft-picking in said passage and equal to or less than a horizontal distance l between a center of said passage and a free end of said support and wherein a vertical distance y between said free end of said support and an inside horizontal edge of said hook is equal to or greater than a vertical distance d between said inside horizontal edge of said hook and a horizontal centerline of said passage.

* * * * *